United States Patent [19]

Trumpower, II

[11] Patent Number: 4,747,527

[45] Date of Patent: May 31, 1988

[54] UTILITY BELT

[76] Inventor: Frederic K. Trumpower, II, 2718 Ariane Dr., San Diego, Calif. 92117

[21] Appl. No.: 18,520

[22] Filed: Feb. 25, 1987

[51] Int. Cl.[4] ..... A45F 13/00

[52] U.S. Cl. ..... 224/224; 224/252; 224/907; 2/311

[58] Field of Search ..... 224/224, 249, 252, 225, 224/226, 256, 269, 271, 272, 904, 907; 2/311, 312, 319

[56] References Cited

U.S. PATENT DOCUMENTS

| | | | |
|---|---|---|---|
| 1,222,264 | 4/1917 | Cabanne | 224/271 |
| 1,600,027 | 9/1926 | Welsand | 224/904 X |
| 3,115,997 | 12/1963 | Hengst | 224/907 X |
| 3,713,299 | 1/1973 | Duncan | 224/224 X |
| 3,743,147 | 7/1973 | Wilczynski | 224/272 X |
| 3,878,589 | 4/1975 | Schaefer | 224/272 X |
| 4,318,502 | 3/1982 | Lowe et al. | 224/226 X |
| 4,581,271 | 4/1986 | Gordon | 2/311 X |

FOREIGN PATENT DOCUMENTS

| | | | |
|---|---|---|---|
| 1068240 | 12/1979 | Canada | 224/252 |

*Primary Examiner*—Henry J. Recla
*Assistant Examiner*—Robert Petrik
*Attorney, Agent, or Firm*—Charles C. Logan, II

[57] ABSTRACT

A utility belt formed from an elongated strip of plastic material having a predetermined length, width and thickness. The plastic material of the elongated strip has inherent torsion resistance to thereby prevent the belt from being twisted more than 90 degrees. The longitudinal flexibility of the elongated strip is such that it can be drawn around a person's waist to form a closed loop belt. Trim molding is attached to the peripheral edges of the elongated strip and it provides stiffening resistance to torsional twisting forces. The inner surface of the belt has hollow tubing attached to one side of the trim molding and it forms a resilient flange around the periphery of the inner surface of the belt. A layer of open cell foam having an egg carton contour on its outer surface is detachably received against the inner surface of the elongated strip between the resilient flanges formed by the hollow tubing. The hollow tubing and open cell foam function to cushion the inner surface of the utility belt against the wearer's body. A plurality of air holes are formed at predetermined locations in the elongated strip of plastic material to allow the belt to breathe. A plurality of snap-lock assemblies have their female portion permanently attached to the outer surface of the elongated strip. The male portion of the snap-lock assemblies may be attached to tool holders of various sizes an configurations.

7 Claims, 1 Drawing Sheet

UTILITY BELT

BACKGROUND OF THE INVENTION

The invention relates to a belt and more specifically to utility belt to be worn around a person's waist and having structure on its outer surface for attaching and carrying articles such as tools or equipment. The utility belt is designed to support the articles or equipment close to the body and has structure to expedite the exchange or transfer and the use of these tools for the purpose of accomplishing work tasks or toteage requirements. Specialized receiviers, receptacles, pockets, hooks, holders, and so forth can be readily attached to the belt by utilizing the snap-lock assemblies whose female portion is permanently attached to the belt and whose male portion is attached to the tool or equipment receiver to be carried.

In the past, the standard structure for carrying tools or equipment has been through the use of tailored pouches or pockets utilized as receivers. A belt usually made of leather or fabric was inserted through a loop or aperture manufactured in the receiver and in this manner the belt and receivers were worn around the waist of the user.

The belts of the present state of the art have several disadvantages and some of these are as follows. (1). The removal of the receivers first necessitates the removal of the belt off of the waist of the user (since the belt is "threaded" through the loop or aperture in the receivers) and then the disengagement of the receivers from the belt. A lack of utility and an unnecessary consumption of time results from such a lengthy process. (2) The receivers are affixed to the belt in a manner which allows them to slide the entire length of the belt when encircled around the waist of the user, thus in a forward prone position a user can experience the receivers shift location abruptly and the contents therein dislodged. (3) The leather and fabric materials used in the present belt systems do not exhibit the inherent torsional stiffness which would prevent distorsion from occuring in the belts shape, contributing to this distorsion is the present belts minimal thickness which rarely exceeds ¼ inch in dimension. (4) Therefore with insufficient torsional stiffness and thickness in the belts material characteristics and dimensions, rolls, sags, twists, and depressions can form parallel to the plane of the users waist, predominately near the receivers, and of a proportion which is linked to the amount of weight and load transfered by the receivers to the belt in this region. Since the receivers are generally worn at the users side near the pelvic hip area, these distorsions in the belt come into contact with the users flesh (though separated by clothing if so worn) and can cause discomfort and pain. The clothing (shirt, pants) does not serve to minimize this substantial abrasive contact caused by the distorsions. (5) The distorsions become more pronounced and severe with time and use, a correlation attributable to the common material composition of the belt systems which are inadequate to prevent stretching, flexure, or convolution. (6) Another disadvantage to the present systems is that the belt must be worn tightly around the users waist otherwise the belt and receivers would slip off of the torso even with modest loading. (7) Inevitably this downward slipping of the belt and receivers results in the users pants slipping down off of the waist also. This effect is awkward and discomforting as well time consuming to remedy. (8) The necessity to wear these present systems quite tightly is due to their inability to bear load properly upon the body frame. (9) Furthermore, in many construction trades a large quantity of tools are worn, therefore this necessitates the wearing of suspenders or straps over the shoulders to help bear the weight which the present belt and receiver systems are incapable of supporting singularly. (10) The present belt systems belt buckle is positioned in the front of the user's abdomen, this substantially unprotected contact can cause gouging and irritation thus discomfort to the user.

It is an object of the invention to provide a novel utility belt which can facilitate the rapid and simplistic removal or attachment of the receivers.

It is also an object of the invention to provide a novel utility belt having structure to provide secure mounting of the receivers on the belt to prevent shifting or dislodgement of the articles contained therein.

It is another object of the invention to provide a novel utility belt which provides comfort along the entire surface in contact with the user's body.

It is another object of the invention to provide a novel utility belt that has sufficient torsional characteristics to present a flush surface in contact with the user's body which will not exhibit rolls, sags, twists and depressions.

It is another object of the invention to provide a novel utility belt that can be worn less tightly than present belt systems.

It is a further object of the invention to provide a novel utility belt that provides greater load bearing capacity, therefore eliminating the need for additional support means such as suspenders or straps.

SUMMARY OF THE INVENTION

Applicant's novel utility belt has been designed for supporting articles secured to the outer surface of the belt. It is formed from an elongated strip of plastic material, such as ABS, having a thickness between 0.050 inches and 0.250 inches. The material of the belt has sufficient torsion resistance to prevent the elongated strip from being twisted more than 90 degrees. Additionally molding is attached to the peripheral edge of the elongated strip around its entire perimeter and the serrated metal clip structure within the interior of the molding provides additional torsional resistance toward preventing the elongated strip from being twisted. As a result of this combination of structure, the weight of tools and other items or articles that are secured in tool holders or other like devices that are attached to the outside surface of the belt is distributed thorughout the width and length of the belt. This difference differs from the state of the art type of leather belt or fabric belt that sag, twist, and form rolls in the area adjacent where the weight of the tool is being supported.

A resilient flange formed from hollow neoprene tubing is attached to the inside surface of the belt adjacent the trim molding and this forms a resilient flange around the periphery of the elongated strip plastic material. A strip of open cell foam is captured within the confines of the resilient flange structure. The surface of the open cell foam that is in intimate contact with the wearer has a contoured surface formed like the interior of an egg carton. The force of the hollow tubing against the wearer's waist functions to both cushion the belt against the wearer and also effects a fractional resistance to the belt slipping downwardly under the weight of the objects carried thereby.

A plurality of snap-lock assemblies have their female portion permanently secured to the outer surface of the elongated strip member. The mating male portions may be attached to holders or receivers such as tool holders. A plurality of strategically placed air holes are formed in the elongated strip member to allow the belt to breathe.

Nylon webbing straps are secured to the respective ends of the elongated strip of plastic material through slots in the outer surface if the strip. A buckle assembly having a female portion and a male portion are attached to their respective ends of the webbing. Since the webbing is attached to the outer surface of the belt, the buckle assembly when assembled in its connected position is in minimal or no contact with the wearer's body thus preventing the buckle from gouging into the wearer's skin.

DESCRIPTION OF THE PREFERRED EMBODIMENT

Figure 1:
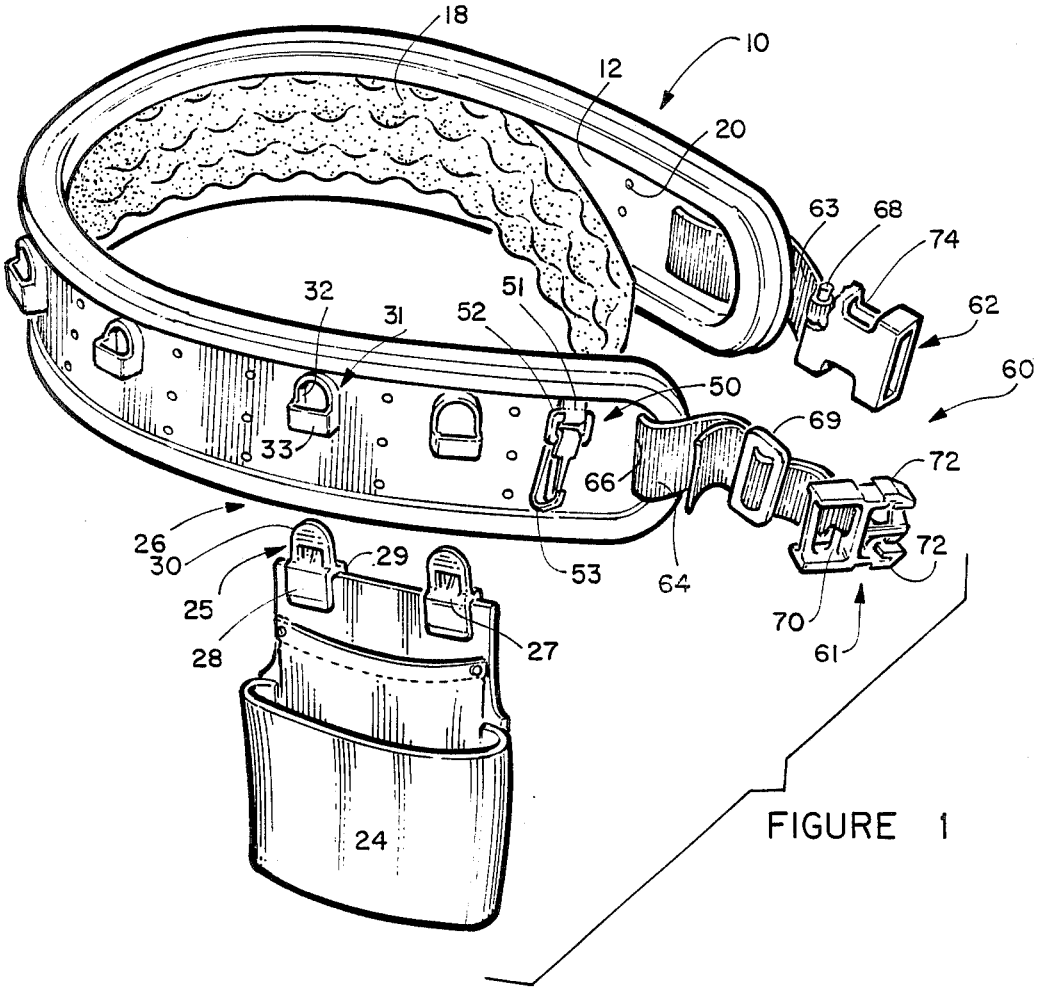
FIG. 1 is a perspective view of applicant's novel utility belt showing portions broken away for clarity.
Figure 2:
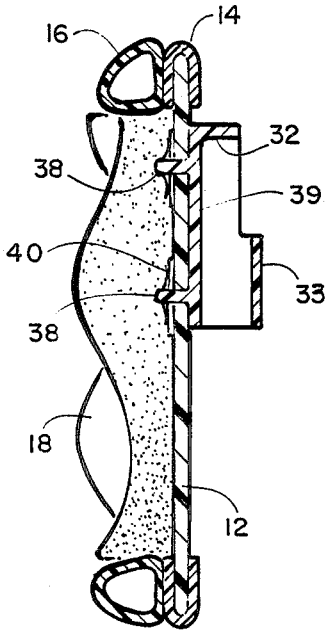
FIG. 2 is a vertical cross sectional view of the novel utility belt.
Figure 3:
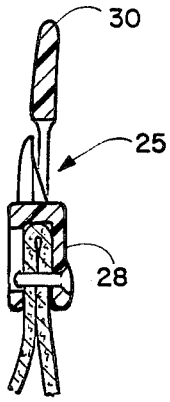
FIG. 3 is a vertical cross sectional view of one of the male portions of the snap-lock assembly where it is attached to the top of the tool holder.

Applicant's novel utility belt will now be described by referring to FIGS. 1 and 2 of the drawing. The utility belt is generally designated numeral 10.

Utility belt 10 is formed from an elongated strip of plastic material 12. It has a trim molding 14 secured to it around its perpheral edge. A hollow tubing 16 is glued to the trim molding 14 and it extends around the perimeter of strip 12 and it forms a resilient inwardly extnding flange. A strip of open cell foam 18 is captured within the resilient flange structure formed by hollow tubing 16. The open cell foam 18 is removable when so desired. A plurality of air holes 20 are formed at predetermined locations in the elongated strip 12 and provide breathability to the belt.

Receivers such as tool holder 24 have the male portion 25 of snap-lock assembly 26 secured to their upper edge. Male portion 25 has a wall 27, downwardly extending laterally spaced flanges 28 and 29, and an upstanding resilient tongue member 30. Female portion 31 of snap-lock assembly 26 has a tongue receptacle area 32, and a locking bar 33. To engage the two members, tongue 30 is slid into the bottom of receptacle area 32 until the tongue 30 springs upwardly and is captured by locking bar 33. To disengage the male portion 25, it is merely necessary to depress tongue 30 and pull downwardly on the male portion 25. A pair of posts 38 extend rearwardly from rear wall 39. These posts pass through apertures in strip 12 and push nuts 40 securely lock onto posts 38 and prevent the detachment of female portion 31 of the snap-lock assembly 26.

A different type of fastener or attachment for holding different things is designated numeral 50. It has a webbing 51 that passes around loop 52 with its free end captured under trim molding 14. A snap member 53 is also pivoted on loop 52.

The buckle assembly 60 is formed from a male portion 61 and a female portion 62, and straps 63 and 64 of nylon webbing. Slots 66 are formed in the respective ends of strip 12 and the free ends of the straps 63 and 64 pass through them and are secured to the inside surface of strip 12 by a solvent. Strap 63 has its other end passing aound a post 68 of female portion 62. Strap 64 passes through a loop 69 and then around a post 70 on male portion 61. The resilient fingers 72 of male portion 61 are compressed into female portion 62 and expand outwardly into apertures 74 to lock in place. To detach the two members from each other it is merely necessary to compress fingers 72 inwardly and pull the male and female portions apart.

I claim:

1. A utility waist belt comprising:

an elongated strip of plastic material having a predetermined width, a predetermined length and a predetermined thickness, said elongated strip having sufficient torsion resistance to prevent said elongated strip from being twisted more than 90 degrees, the longitudinal flexibility of said elongated strip being such that it can be drawn around a person's waist to form a closed loop belt, said elongated strip having an inner surface and an outer surface;

means for detachably securing the opposite ends of said elongated strip together to form a closed loop belt;

cushion means for resiliently supporting said utility belt against the waist of a person wearing said belt, said cushioning means being secured to the inner surface of said elongated strip;

resilient flanges extending outwardly from the inner surface of said elongated strip adjacent its peripheral edge to form spaced walls between which said cushioned means is captured, said resilient flanges being formed of hollow tubing made of neoprene that functions to cushion the belt against the wearer and also effects a frictional resistance to the belts slipping downwardly under the weight of the objects carried thereby; and means for supporting articles secured to the outer surface of said elongated strip.

2. a utility belt as recited in claim 1 further comprising means secured around the edges of said elongated strip for stiffening its resistance to torsional twisting forces.

3. A utility belt as recited in claim 1 wherein said elongated strip is made of ABS plastic.

4. A utility belt as recited in claim 3 wherein the thickness of said elongated strip is greater than 0.050 inches and less than 0.250 inches.

5. A utility belt as recited in claim 1 wherein said means for supporting articles comprises a snap-lock assembly having a male portion and a female portion.

6. A utility belt as recited in claim 1 wherein said cushioning means is formed of open cell foam whose outer surface has a contour similar to the egg receiving structure in the inside of an egg carton.

7. A utility belt as recited in claim 1 further comprising air holes formed at predetermined locations on said elongated strip to allow air circulation between said belt and the body of the person wearing it.

* * * * *